United States Patent [19]

Eysn

[11] 3,963,223

[45] June 15, 1976

[54] METALLURGICAL VESSEL, IN PARTICULAR A CONVERTER

[75] Inventor: Manfred Eysn, Linz, Austria

[73] Assignee: Vereinigte Osterreichische Eisen- und Stahlwerke-Alpine Montan Aktiengesellschaft, Linz, Austria

[22] Filed: July 1, 1974

[21] Appl. No.: 484,781

[30] Foreign Application Priority Data

July 23, 1973 Austria ..... 6469/73

[52] U.S. Cl. ..... 266/241

[51] Int. Cl.[2] ..... C21C 5/46

[58] Field of Search ..... 266/34–36 P

[56] References Cited

UNITED STATES PATENTS

| | | | |
|---|---|---|---|
| 3,291,541 | 12/1966 | Dellinger | 266/36 P |
| 3,588,072 | 6/1971 | Matsumoto et al. | 266/36 P |
| 3,601,379 | 8/1971 | Langlitz et al. | 266/36 P X |
| 3,687,436 | 8/1972 | Wortman | 266/35 |
| 3,719,355 | 3/1973 | Suette et al. | 266/35 |
| 3,799,524 | 3/1974 | Menu | 266/35 |
| 3,817,504 | 6/1974 | Vonnemann | 266/35 |

FOREIGN PATENTS OR APPLICATIONS

| | | |
|---|---|---|
| 1,270,073 | 7/1961 | France |

*Primary Examiner*—Gerald A. Dost
*Attorney, Agent, or Firm*—Brumbaugh, Graves, Donohue & Raymond

[57] ABSTRACT

The invention relates to a metallurgical vessel, in particular to a converter, which in zones of heavy thermal wear, particularly between the carrying ring and the converter mouth, is provided with tube spirals flown through by a coolant. The tube spirals comprise open profiles or tube halves of semicircular cross section welded to the jacket of the metallurgical vessel. At one end the tube spirals are connected to a coolant collector and at the other end to a coolant distributor. The tube spirals have the form of a "U", wherein the tubes forming the legs of the U are arranged along the generatrix of the converter jacket and the leg ends of one tube spiral are connected with the leg ends of the following tube spiral by means of connecting conduits.

12 Claims, 12 Drawing Figures

METALLURGICAL VESSEL, IN PARTICULAR A CONVERTER

BACKGROUND OF THE INVENTION

The invention relates to a metallurgical vessel, in particular to a converter having a steel jacket, which at zones subjected to heavy thermal wear, in particular in the range between carrying ring and converter mouth, is provided with tube spirals flown through by a coolant. The tube spirals comprise open profiles or tube halves of preferably semicircular cross section welded to the converter jacket and connected on one end to a coolant distributor and on the other end to a coolant collector.

It is important to protect the parts of industrial furnaces, which are subject to heavy thermal wear from detrimental heat influences, by means of special cooling devices. In oxygen converters it is essential to cool te so-called converter hood, i.e. that part of the converter which extends above the carrying ring as far as the converter mouth. From German Utility Model No. 7,127,402 Such a converter-hood-cooling device is known. This device consists of individual tubes split in the longitudinal tube direction and welded to the converter jacket. Several tube spirals are combined to form tube-spiral groups and are connected to a common coolant distributor and coolant collector, respectively. According to this known construction the tube halves are bent along the largest part of the converter-jacket circumference in planes running perpendicular to the converter axis, i.e. in horizontal planes when the converter is in perpendicular position. It is a further feature of the known cooling device that for achieving an equalization of pressure and of the flow of the coolant, the tube halves of each group are connected with each other at at least one point by means of transverse canals.

In the known cooling systems, in which the cooling water flows predominantly horizontal through a plurality of tubes when the converter is in the operating position, a corrosion of the tube walls may occur, caused by the air and other gases carried along with the cooling water. The circumferential zone of the tubes which lies highest in the horizontal part of the cooling system is liable to this corrosion. In such a case the cooling device of the converter has to be put out of operation and new tubes have to be installed. Another disadvantage lies in the fact that on account of the curvature of the converter hood the tubes have to be mounted in several circumference zones of differing diameters, which means that a lot of assembly work has to be carried out. In addition to this aforementioned disadvantage several tube-spiral groups when arranged one above the other have to be connected by inclined connecting tubes which have to be bent in two planes.

SUMMARY OF THE INVENTION

It is the object of the present invention to provide a simple cooling device having an advantage in the mounting of the tubes, namely that the tubes are to be bent in one plane only. The portion of tube zones in which the coolant flows in the horizontal direction while the converter is in the operating position, is, however, to be kept as small as possible. Moreover, the number of construction elements is to be reduced, i.e. the aim is to use as many uniform construction elements as possible. This not only makes the production easier and cheaper, but also facilitates the equalization of the coolant flow, the reduction of pressure loss in the tube conduits and a more uniform cooling of the converter walls. The cooling system of the invention should be applicable not only in the hood of converters, but also in other highly stressed walls of metallurgical vessels.

In a metallurgical vessel of the above described type the invention consists in that the tube spirals are u-shaped. The tubes forming the legs of the U are arranged side by side along the generatrix of the converter jacket and the leg ends of one spiral are connected with the leg ends of the following spiral by means of connecting conduits.

In order to be able to operate with the smallest possible number of tube pieces, it is particularly advantageous to arrange the tube spirals in the form of meanders.

A particularly preferred embodiment for larger converters, which require a great amount of cooling water per time unit, consists in that the u-shaped tube spirals are combined in groups, wherein the leg ends of one group are connected with the leg ends of the following group by coolant distributors and coolant collectors, respectively, arranged in one single horizontal plane.

It is suitable that all coolant distributors and coolant collectors be arranged in a plane just above the carrying ring and that the supply conduit and the discharge conduit for the cooling water be arranged parallel to and at either side of a vertical plane laid through the trunnion axis.

It is also possible, however, to arrange all of the coolant distributors and coolant collectors below the converter mouth and to arrange the supply conduit and the discharge conduit for the cooling water in the range of a vertical plane laid through the trunnion axis.

In order to avoid clamping the converter jacket too strongly all around, a further feature of the invention requires an expansion gap between each collector and distributor welded to the converter jacket.

Of course it is also possible to arrange the coolant collectors and coolant distributors welded to the converter jacket in a manner known per se in which they are in the form of a ring conduit with vertical separating walls. The use of tube conduits to which tube spirals are connected, wherein separating walls are built in so that these tube conduits have at the same time a distributing and a collecting function for the flowing medium, is known from French Patent No. 1,270,073, which is directed to a heat exchanger.

When in tiltable converters there is no room or possibility to lay a supply or discharge conduit for the coolant through the supporting trunnion on the so-called drive side, where the fixed bearing is arranged, it is advantageous for the coolant distributor connected to the coolant-supply-conduit to be arranged next to the collant collector connected to the coolant-discharge-conduit, preferably on the expansion-bearing side lying opposite the tilt drive of the converter.

BRIEF DESCRIPTION OF THE DRAWINGS

The invention will now be described in more detail by way of example with reference to the accompanying drawings in which.

DESCRIPTION OF EXEMPLARY EMBODIMENTS

Figure 1:
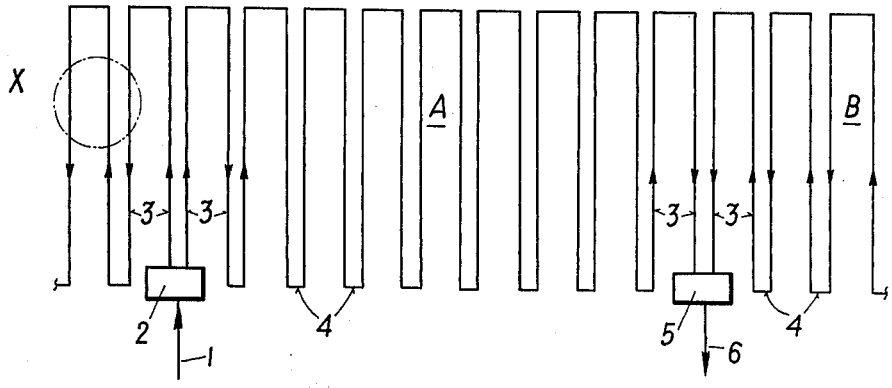
FIGS. 1, 2, 3 and 4 are circuit diagrams of different cooling systems according to the invention, one cooling system at a time of an unrolled cylindrical cooling surface is illustrated simplified in a side view.

In FIG. 1, reference number 1 denotes a schematically illustrated coolant-supply-conduit for a coolant distributor 2. The u-shaped tube spirals of the conduit are connected in the form of a meander to create two systems A and B. The tubes forming the legs of the U are arranged along generatrices of the cylindrical surface (cooling surface) of the metallurgical vessel and are connected with the leg ends of the following tube spiral 3 by means of connecting conduits 4. The flow direction of the coolant is denoted by arrows. Reference number 5 indicates a coolant collector common to the systems A and B, to which the coolant-return-conduit 6 is connected. When using this system for cooling a converter the coolant coollector 5 and the coolant distributor 2 lie opposite each other in a vertical plane laid through the supporting-trunnion axis.

Figure 2:
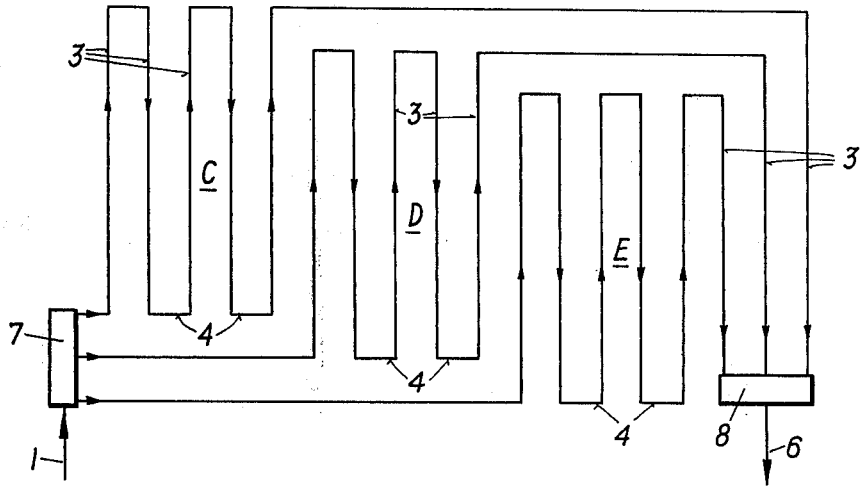

In FIG. 2 three cooling systems C, D and E are connected to a coolant distributor 7, for which systems a common coolant collector 8 is provided. Each cooling system (C, D and E) consists of a number of u-shaped tube spirals 3 with connecting conduits 4.

Figure 3:
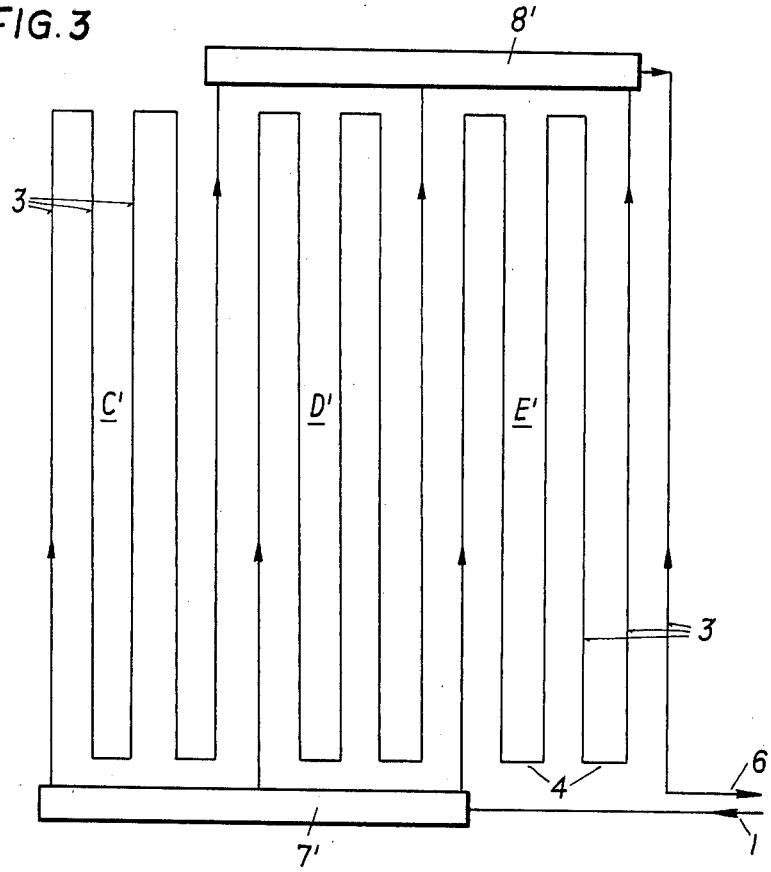

FIG. 3 is an illustration analogous to FIG. 2, where again three cooling systems (C′, D′ and E′) are connected to a coolant distributor 7′, for which systems a common coolant collector 8′ is provided. The coolant collector 8′ is arranged above the tube spirals 3 which are arranged in form of meanders.

Figure 4:
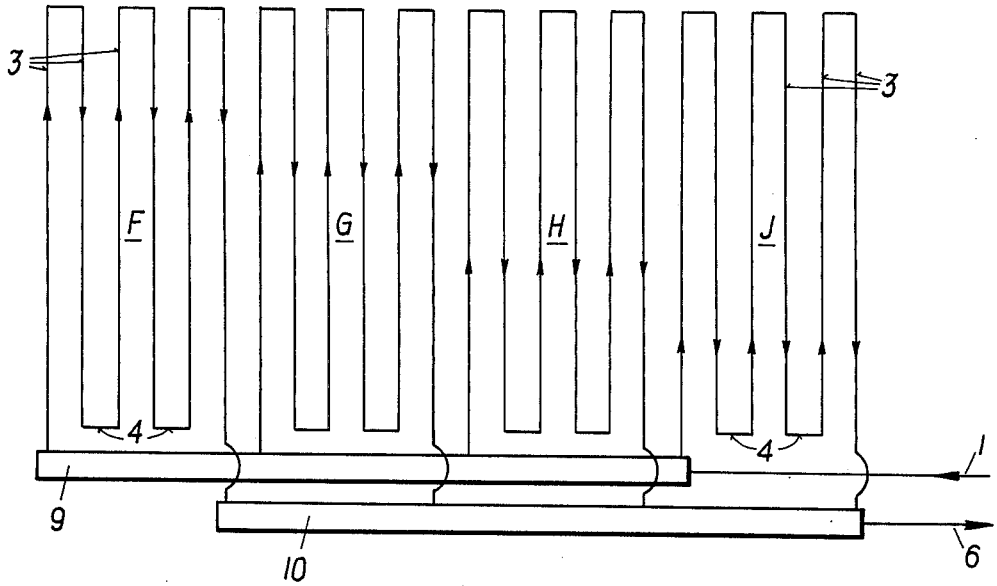

FIG. 4 illustrates a system of u-shaped tube spirals 3 connected to a common coolant distributor 9 and to a common coolant collector 10, respectively, in such a way that independent self-contained cooling systems (F, G, H and J) are formed.

Figure 5:
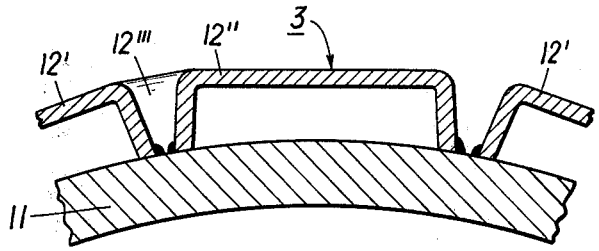
FIGS. 5 and 6 show — on an enlarged scale — a detail indicated with "X" in FIG. 1, each in a section perpendicular to the cooling surface, which corresponds to the plane of the drawing, and for two different embodiments for the profiles for the tube halves to be used for the coolant.

FIG. 5 shows an example of the formation of a tube spiral 3 that consists of the tubes 12′ and 12″, which form the two legs of the U. These tubes are arranged along the generatrix of the cooling surface 11 and are connected together by the connecting-tube piece 12‴. The tube profile also has the form of a U. It may, however, also be produced by dividing a closed tube of rectangular cross section into two halves.

Figure 6:
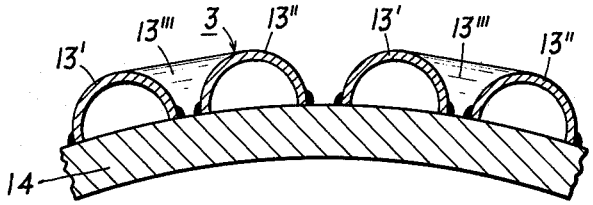

In FIG. 6, which is an illustration similar to FIG. 5, semicircular tubes 13′ and 13″ are used for forming the legs of the U. The bottom of the u-shaped curve is denoted with 13‴ and the converter surface with 14.

Of course it is also possible to use tubes having a cross section that differs from the rectangular or the semicircular form. However for passing large quantities of water per time unit through cooling systems of the above described type, wherein each system (A to J) consists of a single tube, a tube cross section according to FIG. 5 is particularly advantageous.

Figure 7:
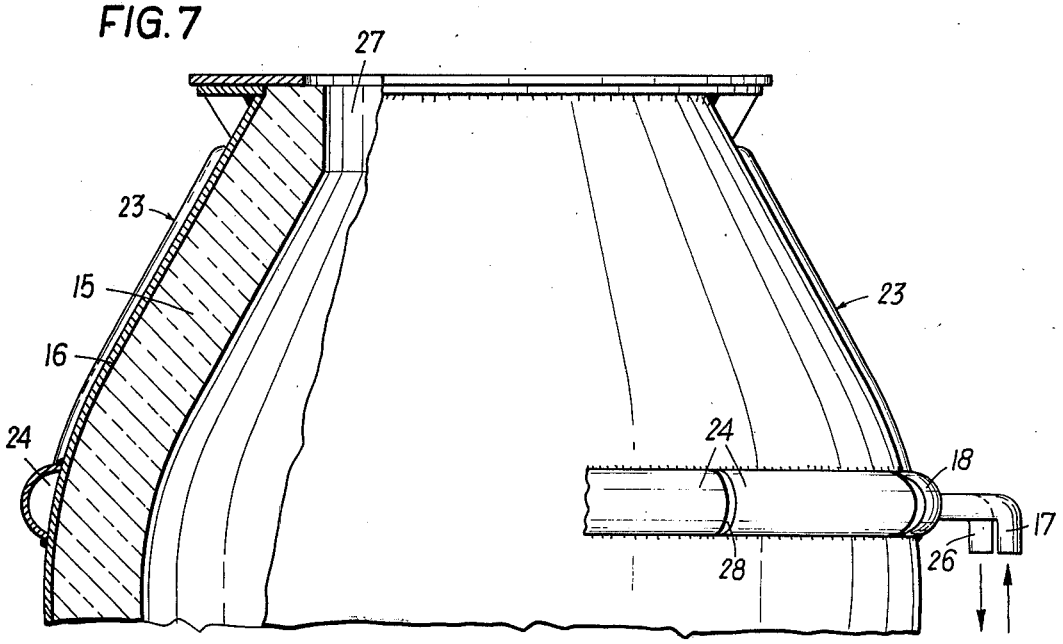
FIGS. 7, 9 and 11 each show the upper part of a converter provided with a cooling system of the invention, partly drawn in a section and partly in side view.

In FIG. 7, reference number 15 denotes the refractory lining in the hood of a converter, which is provided with a steel jacket 16. On the one side, preferably on the expansion-bearing side lying opposite the tilt drive, the conduit 17 for the supply of cooling water is arranged. This conduit 17 is connected to a coolant distributor 18 welded to the converter jacket.

Adjacent, i.e. in a common horizontal plane, further coolant distributors and coolant collectors 24 are provided all around. Each of the distributors and collectors connects the leg ends of u-shaped tube spirals 19, 20, 21, 22. (See FIG. 8.) The tube spirals 19, 20, 21, 22 form a common tube spiral group, each of the tubes forming the U-legs being arranged along the generatrix of the converter jacket 16. Thus, the tube pieces 24 welded to the converter jacket have both a collecting and a distributing function because they connect the tube spiral groups 23 with each other. The last tube piece 24 going clockwise from the distributor 18 is connected to the coolant collector 25, which in turn is connected to the coolant-return-conduit 26. The coolant distributor 18 and the coolant collector 25, and the cooling-water-supply conduit 17 and the cooling-water-return conduit 26, thus lie side by side. As can be seen the various cooling water tubes extend substantially along the generatrix of the converter jacket 16, namely in the range between the carrying ring (not illustrated) and the converter mouth 27. An expansion gap 28 is provided between each of the horizontally arranged coolant distributors and coolant collectors (18, 24 and 25,) results in a more favorable mechanical wear of the cooling system under the inevitable heat expansions of the converter jacket 16. The clamping of the converter caused by the tube sections 18, 24 and 25, is distributed along relatively short circumference zones, so that cracks in the welding seams of the cooling system cannot occur. Deformations of the cooling surface can also be prevented much more easily. Basically it is also possible to use a ring conduit closed all around, into which separating walls are built in for generating the flow denoted by the arrows in FIG. 8. These separating walls may also be provided with openings for the purpose of pressure and flow equalization, as is described in French Patent No. 1,270,073. Finally, between the individual tube spirals (19, 20, 21 and 22), one or several transverse canals may be provided for the same purpose.

Figure 8:
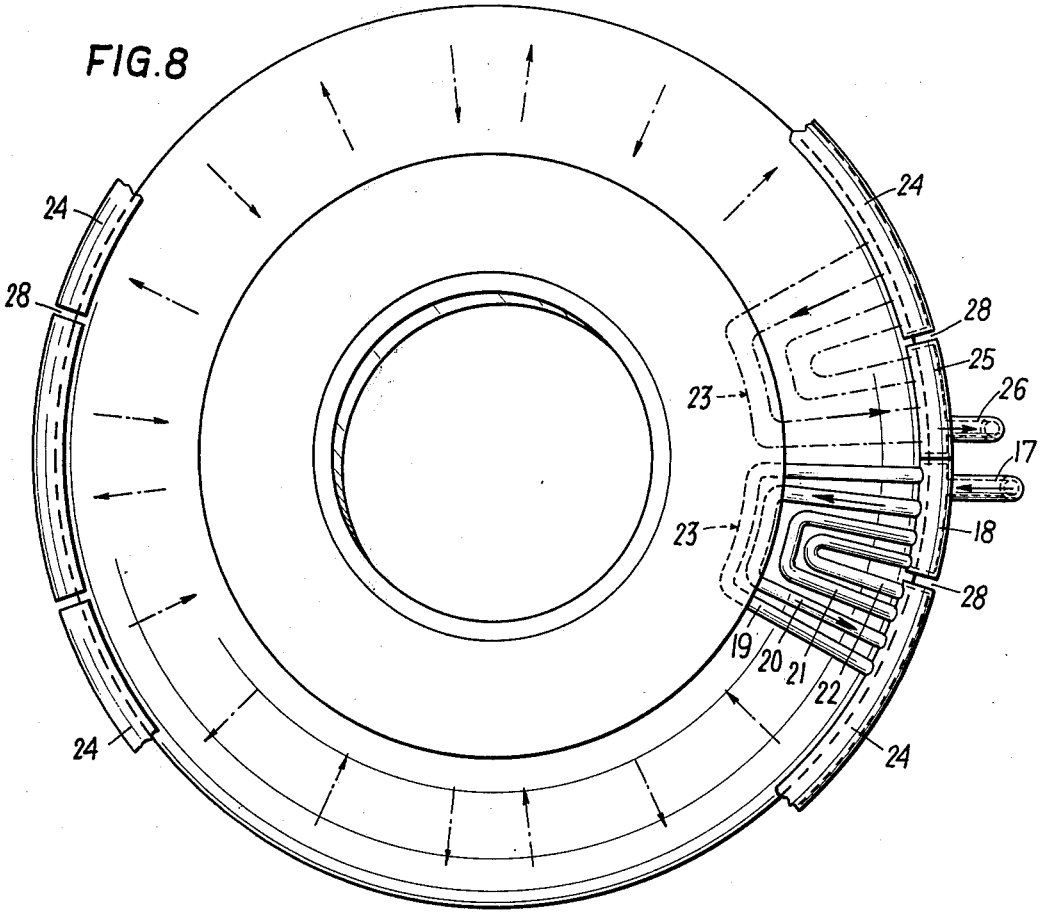
FIGS. 8, 10 and 12 are the pertaining top views for FIGS. 7, 9 and 11, respectively.
Figure 9:
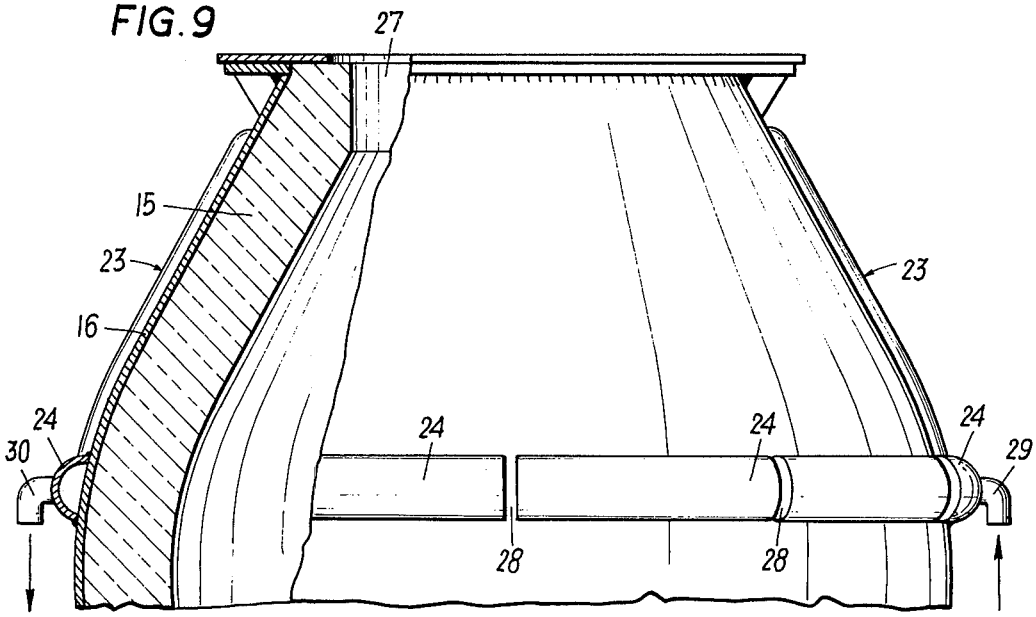
Figure 10:
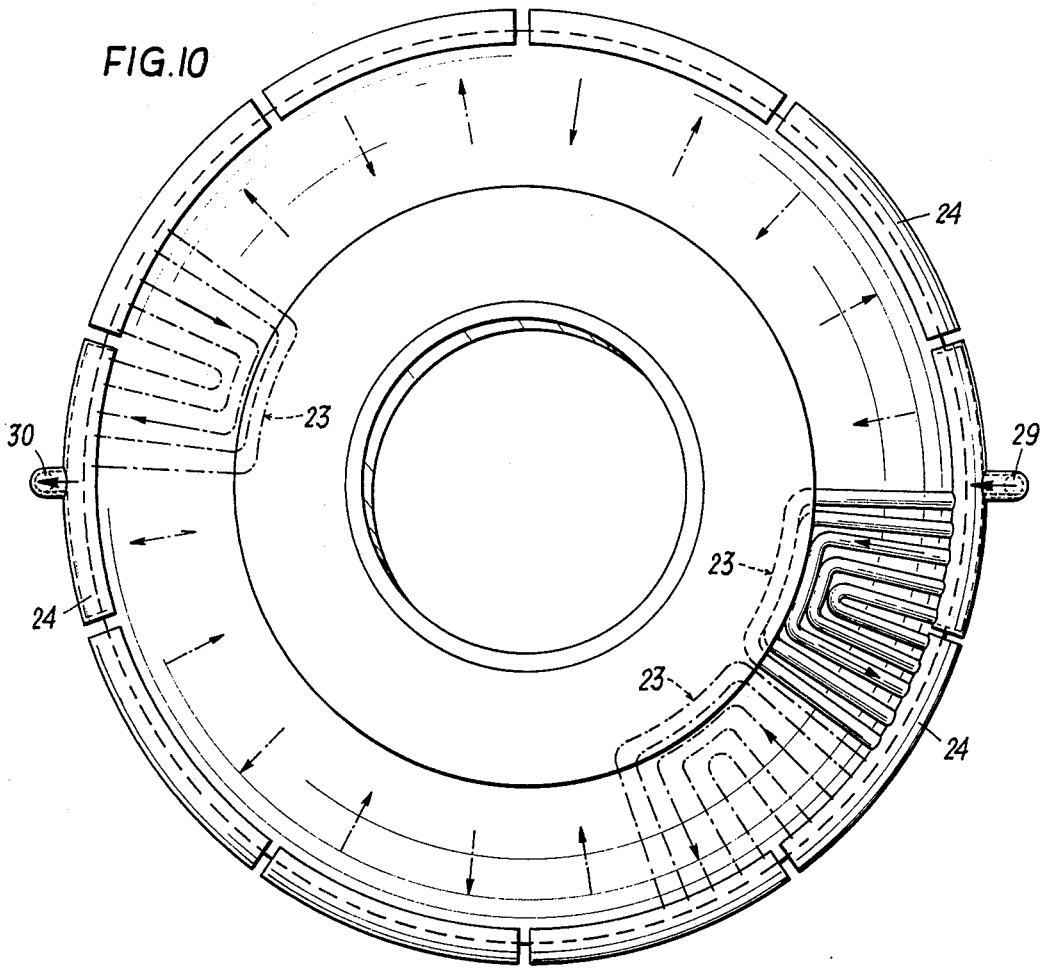

FIGS. 9 and 10 illustrate a modified embodiment of the cooling system shown in FIGS. 7 and 8. The cooling-water-supply conduit 29 lies opposite the cooling-water-return conduit 30 in this embodiment of the invention. However, as with the embodiment of FIGS. 7 and 8 equal coolant distributors and coolant collectors 24 are provided all around the converter in one single plane. Also, an expansion gap 28 is arranged in between the distributors and collectors.

Figure 11:
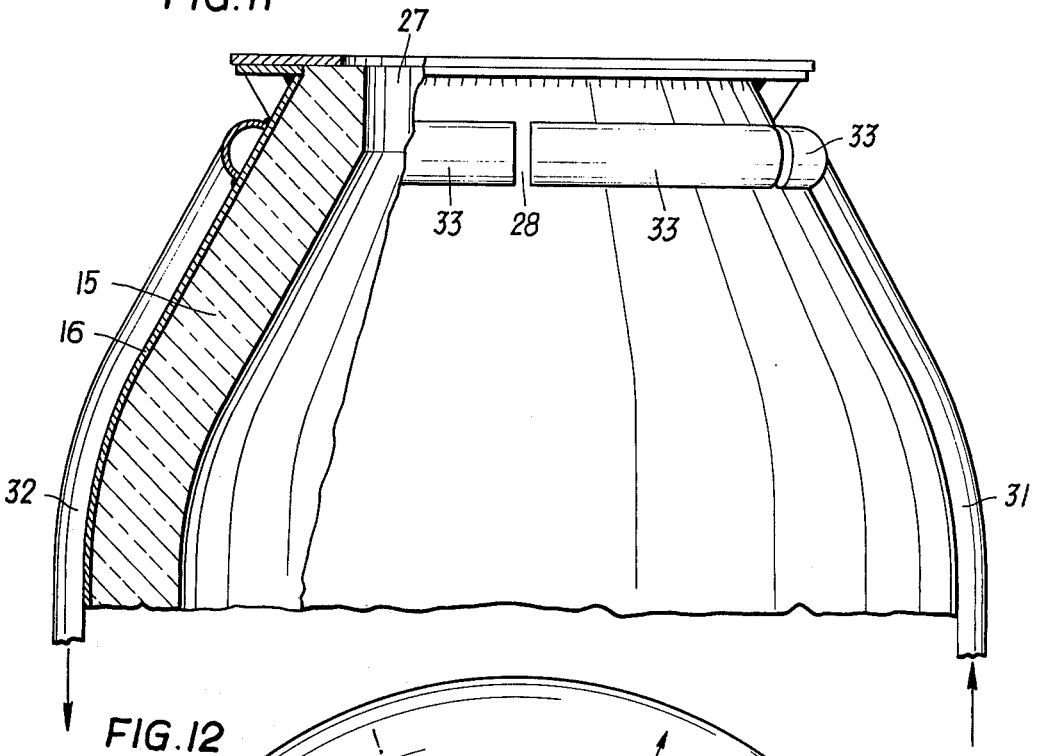
Figure 12:
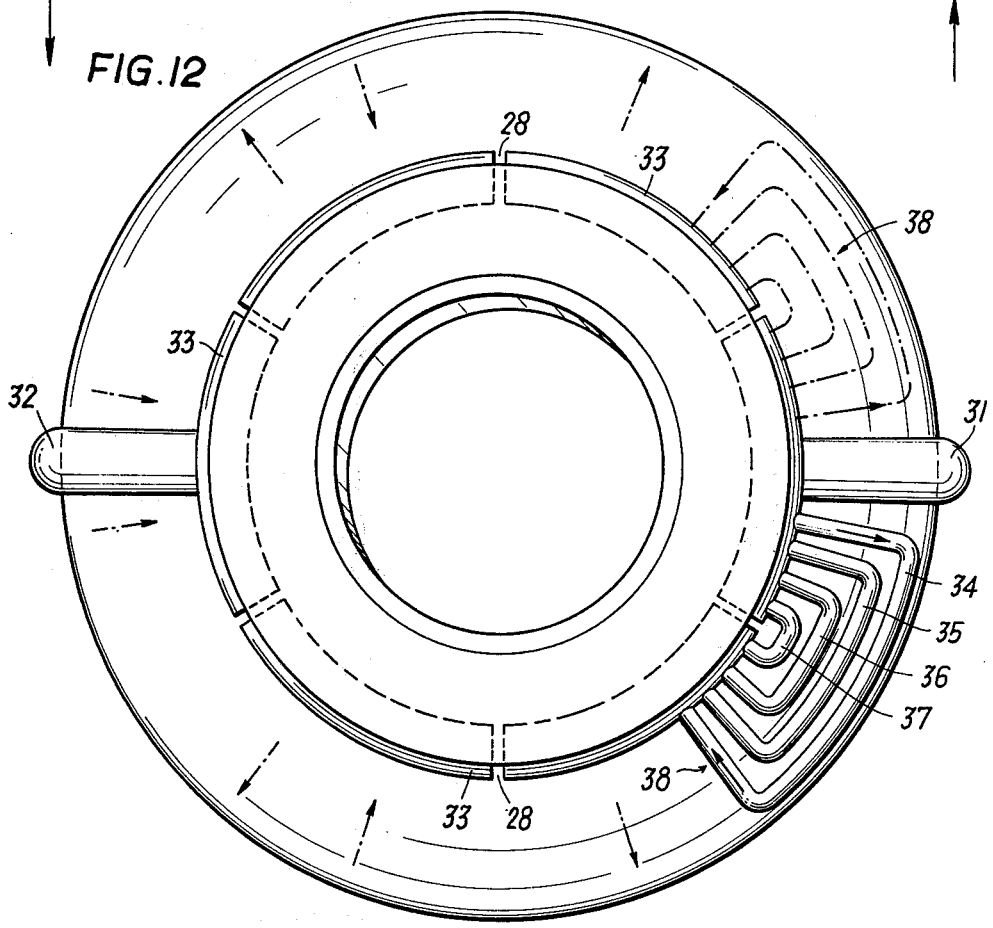

The cooling system according to FIGS. 11 and 12 differs from the cooling system illustrated in FIGS. 7 to 10 in that it is provided with a cooling-water-supply conduit 31 reaching close to the converter mouth 27 and the coolant distributors and coolant collectors 33 are arranged in a horizontal plane below the converter mouth 27. The cooling-water-return conduit is denoted with 32. The u-shaped tube spirals forming a tube spiral group 38 are denoted with 34, 35, 36 and 37.

What I claim is:

1. A metallurgical vessel, e.g. a converter having a converter mouth, said metallurgical vessel being surrounded by a steel jacket, carried in a carrying ring, rotatable about a trunnion axis, provided with an expansion bearing and a tilt drive, the expansion bearing lying opposite the tilt drive, said metallurgical vessel being provided in zones of heavy thermal wear with a plurality of tubes through which a coolant flows, the tubes having a generally semicircular cross section and being welded to the jacket of the metallurgical vessel, one end of the series of tubes being connected to a coolant distributor and on the other end being connected to a coolant collector, a coolant-supply-conduit and a coolant-discharge-conduit being connected to said distributor and collector, respectively, wherein the improvement comprises a U-shape for the tubes, each U-shaped tube having its own separate base and leg sections, the tubes forming the legs of the U-shape being arranged side by side in the vertical direction with the base of the U-shape at one end when the vessel is in its operating position, said tubes being located along a generatrix of the jacket of the metallurgical vessel and the leg ends of one U-shaped tube being connected with the leg ends of the adjacent tube by connecting conduits.

2. The metallurgical vessel set forth in claim 1, wherein the zones of heavy thermal wear lie in a range between the carrying ring and the converter mouth.

3. The metallurgical vessel set forth in claim 1, wherein the U-shaped tubes comprise tube halves of semicircular cross section welded to the jacket of the metallurgical vessel.

4. The metallurgical vessel set forth in claim 1, wherein the U-shaped tubes are arranged in series in a meandering or zig-zag form.

5. The metallurgical vessel set forth in claim 1 wherein the U-shaped tubes are combined in groups, the leg ends of one group being connected with the leg ends of the following group by means of said connecting conduits, said connecting conduits being in the form of additional coolant distributors and coolant collectors arranged in a single horizontal plane.

6. The metallurgical vessel set forth in claim 5, wherein all coolant distributors and all coolant collectors are arranged in a plane just above the carrying ring and wherein the coolant-supply-conduit and the coolant-discharge conduit are arranged parallel to and at either side of a vertical plane laid through the trunnion axis of the metallurgical vessel.

7. The metallurgical vessel set forth in claim 5, wherein all coolant distributors and all coolant collectors are arranged just below the converter mouth and wherein the coolant-supply-conduit and the coolant-discharge-conduit are arranged in a vertical plane laid through the trunnion axis of the metallurgical vessel.

8. The metallurgical vessel set forth in claim 5, wherein the coolant collectors and the coolant distributors are welded to the jacket of the metallurgical vessel in such a way that an expansion gap is provided between them.

9. The metallurgical vessel set forth in claim 5, wherein the coolant collectors and the coolant distributors are welded to the jacket of the metallurgical vessel and are in the form of a ring conduit with vertical separating walls.

10. The metallurgical vessel set forth in claim 1, wherein the coolant distributor connected to the coolant-supply-conduit is arranged adjacent to the coolant collector connected to the coolant-discharge-conduit.

11. The metallurgical vessel set forth in claim 1, wherein the coolant distributor connected to the coolant-supply-conduit is arranged adjacent to the coolant collector connected to the coolant-discharge-conduit, at the side of the expansion bearing lying opposite the tilt drive of the metallurgical vessel.

12. Apparatus for cooling a metallurgical vessel with a metal jacket, e.g. a converter, comprising:

a plurality of U-shaped tubes welded to the vessel jacket in zones of heavy thermal wear, each U-shaped tube having its own separate base and leg sections, said tubes having an open profile whose cross-section appears in the form of half a closed tube, the legs of the U-shaped tubes being arranged side by side in a generally vertical direction with the base at one end when the vessel is in its operating position, said tubes being located along a generatrix of the vessel jacket;

connecting conduits for connecting the leg ends of each U-shaped tube with the leg ends of the adjacent tube;

a coolant distributor means connected to one end of the plurality of tubes;

a coolant collector means connected to the other end of the plurality of tubes;

a coolant-supply conduit connected to said coolant distributor means for supplying coolant to said coolant distributor means so that coolant can be flowed through said tubes; and a coolant-return conduit connected to said coolant collector means for completing the flow path for the coolant in said tubes.

* * * * *